United States Patent [19]

Lyon

[11] Patent Number: 5,025,945

[45] Date of Patent: Jun. 25, 1991

[54] BEVERAGE CONTAINERS

[76] Inventor: Christopher J. Lyon, Rte. 2, Box 400, Estill, S.C. 29918

[21] Appl. No.: 457,684

[22] PCT Filed: Jul. 13, 1988

[86] PCT No.: PCT/GB88/00564

§ 371 Date: Jan. 10, 1990

§ 102(e) Date: Jan. 10, 1990

[87] PCT Pub. No.: WO89/00533

PCT Pub. Date: Jan. 26, 1989

[51] Int. Cl.[5] ..... B65D 17/44

[52] U.S. Cl. ..... 220/85 H; 222/81; 222/131; 220/259; 220/277; 220/278; 220/345

[58] Field of Search ..... 220/85 H, 254, 259, 220/278, 277, 337, 345, 350, 408, 410, 669, 675, 635; 222/81, 130, 131, 183; 215/1 C

[56] References Cited

U.S. PATENT DOCUMENTS

| | | | |
|---|---|---|---|
| 979,072 | 12/1910 | Javins | 220/278 |
| 1,149,840 | 8/1915 | Lange | 220/278 |
| 1,920,385 | 8/1933 | Hamilton | 220/254 |
| 2,601,939 | 7/1952 | Grob | 220/278 |
| 2,665,038 | 1/1954 | Fowler | 220/345 |
| 2,675,945 | 4/1954 | Hahn | 222/88 |
| 3,013,691 | 12/1961 | Prentice | 220/408 |
| 3,760,972 | 9/1973 | McKirnan | 220/410 |
| 4,245,685 | 1/1981 | Nemitz et al. | 220/306 |
| 4,437,575 | 3/1984 | Hahn | 220/410 |
| 4,561,560 | 12/1985 | Lyon | 220/278 |
| 4,671,424 | 6/1987 | Byrns | 220/408 |
| 4,673,813 | 6/1987 | Sanchez | 220/254 |
| 4,804,097 | 2/1989 | Alberghini et al. | 215/1 C |

FOREIGN PATENT DOCUMENTS

| | | | |
|---|---|---|---|
| 382838 | 10/1987 | Austria . | |
| 2624486 | 12/1977 | Fed. Rep. of Germany | 220/254 |
| 534560 | 1/1955 | France | 220/278 |

*Primary Examiner*—Stephen Marcus
*Assistant Examiner*—S. Castellano
*Attorney, Agent, or Firm*—Jones, Tullar & Cooper

[57] ABSTRACT

A liquid container comprises an open topped vessel of generally rectangular cross-section which tapers from top to bottom and has a lid pivoted to one side wall. The lid has projecting puncture structure which pierces the top of a sealed, semi-rigid package of a beverage, such as fruit juice, when the package is located in the vessel and the lid is closed. A slider closure member is mounted in a slideway structure on the top of the lid so as to be slidable along a rectilinear path over two apertures to either close or open both the apertures. The apertures communicate with the interior of the semi-rigid package in the vessel via passage in the puncture structure when the lid is closed. One aperture is an outlet through which liquid is poured and the other is a vent hole. Recesses in each side wall are provided for holding the package.

10 Claims, 5 Drawing Sheets

12
19E
20B
14
19
18
19D
16
19A
22
12
14
13
29
31
19B
16B
21A
19C
17
17B
17A
21F
16A
11
25
10
26
26
23
28
27
27

BEVERAGE CONTAINERS

This invention is concerned with beverage containers of the kind which comprises an open topped vessel having a rectangular cross-section and being formed of a rigid, usually clear, material in which a sealed semi-rigid rectangular beverage container (known as an aseptic package) is to be placed, the cross-section of the bottom of the open topped vessel being substantially the same as that of the container that is to be placed thereon, and a hinged lid which has depending puncture means associated respectively with a vent hole and an outlet through which liquid can be poured from the container, the outlet and the vent hole being formed in the lid which is arranged so that the puncture means pierce the top of a sealed container placed within the open topped portion as the lid is closed, there being passages in each puncture means leading to the respective one of the outlet and the vent hole whereby liquid contained in the semi-rigid container can be poured through the outlet via the respective passage in the puncture means. U.S. Pat. No. 4,561,560 shows such a beverage container.

Beverage containers of the kind referred to cannot be stored with their end faces abutting if they are provided with a conventional handle. This means the number of such vessels that can be stored in a confined space, such as in an airliner, is limited and there is a lot of waste space between them. On the other hand such vessels can be difficult to hold if they have no handle, because the rigid plastics material from which they are usually formed becomes slippery if it gets wet as can happen.

An object of this invention is to provide such a container with effective means for holding it to pour beverage from it and which can be stacked closely.

According to one aspect of this invention there is provided a beverage container of the kind referred to wherein the open topped vessel tapers from its top to its bottom and has a recess formed in a side wall to receive fingers of a hand by which the container is gripped. Preferably there is such a recess in each of an opposed pair of side walls. The recesses may be serrated or profiled to form individual finger portions.

It is surprising that the inward projection that comprises the wall of such a recess does not obstruct the insertion of a semi-rigid beverage container into the open topped vessel in which that recess is formed. This is because, to facilitate stacking of similar containers one upon another, I have arranged that the open topped vessel is tapered towards its base to an extent which is greater than that which is usually required for plastics moulding purposes. As a result the recess is formed in a part of the open topped vessel having a larger cross-sectional area than the semi-rigid beverage container placed in it. Secondly the side walls of such semi-rigid containers are sufficiently flexible to be deformed as they pass the inward projection, the beverage, being a liquid, ensuring that the form of a semi-liquid container so deformed is restored once it has passed the projection.

Preferably the beverage container includes a closure member and constraining means on the lid whereby the closure member is constrained for sliding movement relative to and in contact with the lid between one position in which it closes the outlet and the vent hole and another position in which they are both open to allow a discharge of liquid from the container through the outlet. The closure member may be offset relative to the longitudinal axis of the lid so that it can be moved between said two positions. Conveniently the closure member is a flat elongate slider which is constrained by said constraining means for lengthwise rectilinear movement relative to the lid. Preferably locating ribs are provided at spaced locations on the upper portions of the inner surface of the longer side walls of the rectangular open topped vessel for locating a beverage container therein relative to the puncture means, so that the beverage container may be inserted either way round.

Each depending puncture means is preferably tapered downwardly. It may be provided with sealing means adapted to seat upon the top of a sealed liquid container within the open topped vessel, around the aperture formed in that sealed container by piercing with the puncture means as the lid is closed, to seal against seepage of beverage liquid from within the container around the puncture means. Alternatively, the sealed liquid container may be provided with two perforatable membranes, each in a region which is to be pierced by a respective one of the two puncture means, the perforatable membranes being formed of a material which closely conforms to the exterior of the puncture means as it is pierced by the puncture means so as to form a seal therearound. Provision of such sealing means enables the beverage container with a sealed semi-rigid liquid container therein to be shaken with the lid closed as is often desirable with juices, etc.

The open-topped vessel may be recessed at its bottom for stacking. The top of the lid may be provided with an upstanding wall surrounding a rectangular space within which the bottom of the open topped vessel of another, similar container can be received for location when stacked thereon.

One form of beverage container in which this invention is embodied will be described now by way of example with reference to the accompanying drawings, of which:

Figure 5:
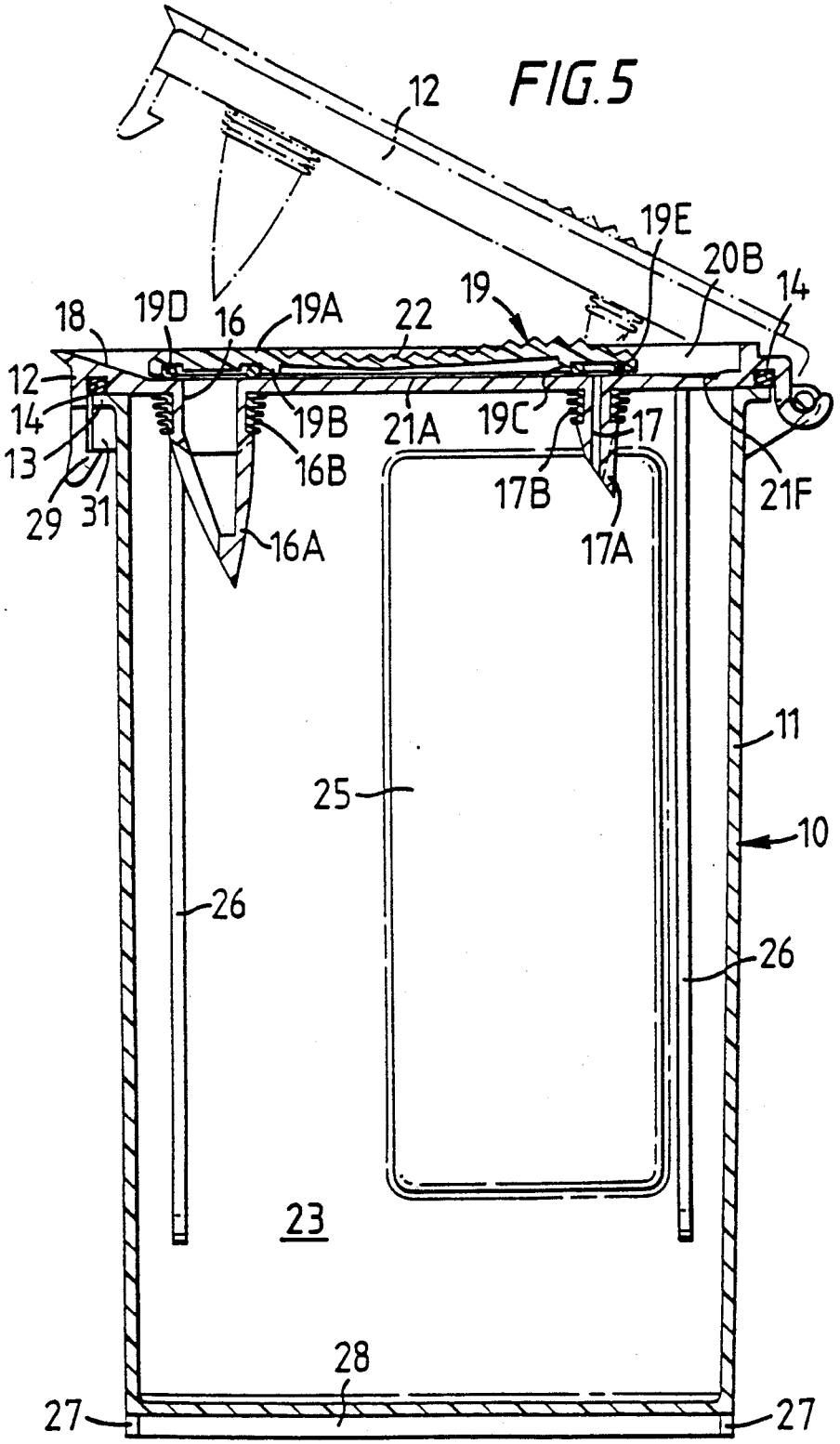
FIG. 5 is a section on the line V—V in FIG. 3, a partially-open position of the lid being shown chain-dotted.

The drawings shown a liquid container which comprises an open topped vessel 10 of generally rectangular cross-section formed of a clear rigid plastics material appropriate for use in a dishwasher. The vessel 10 comprises a base and four side walls and tapers from its top to its base. A lid 12 is hinged to a shorter one, 11 of the side walls and is pivotable between one position shown in full lines in FIGS. 1, 2 and 5 in which it closes the top of the vessel 10 and another position in which the vessel 10 is open for loading. The lid 12 is shown chain-dotted in FIG. 5 between those two positions. The open-topped vessel 10 has an outwardly-extending peripheral flange 13 at its brim. The lid 12 is provided with an 'O'-ring seal 14 around its perimeter for engagement with the flange 13 when it is closed, as shown in FIG. 5.

Figure 6:
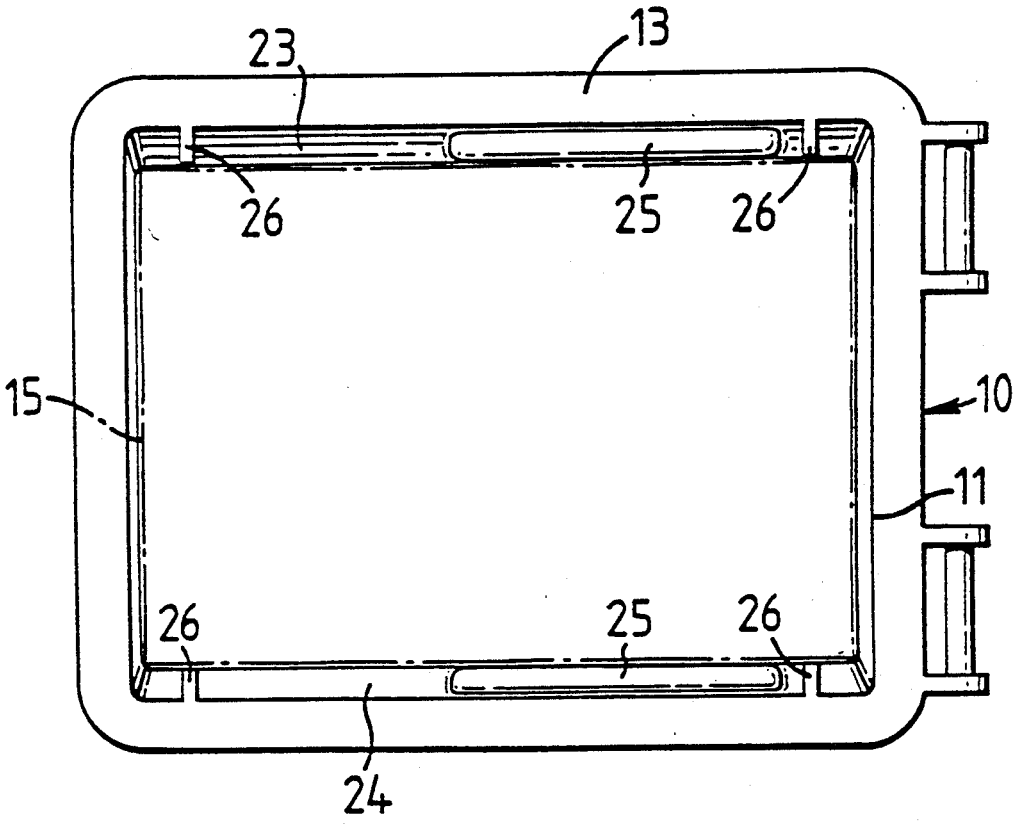
FIG. 6 is a plan view of the container shown in FIG. 1 with the lid removed.

The container is designed to be filled by being loaded with a sealed semi-rigid rectangular container 15. (shown chain-dotted in FIG. 6) which is full of a beverage such as fruit juice. The sealed semi-rigid container is placed in the vessel 10 and its height is such that its top is approximately at the top of the vessel 10.

Figure 3:
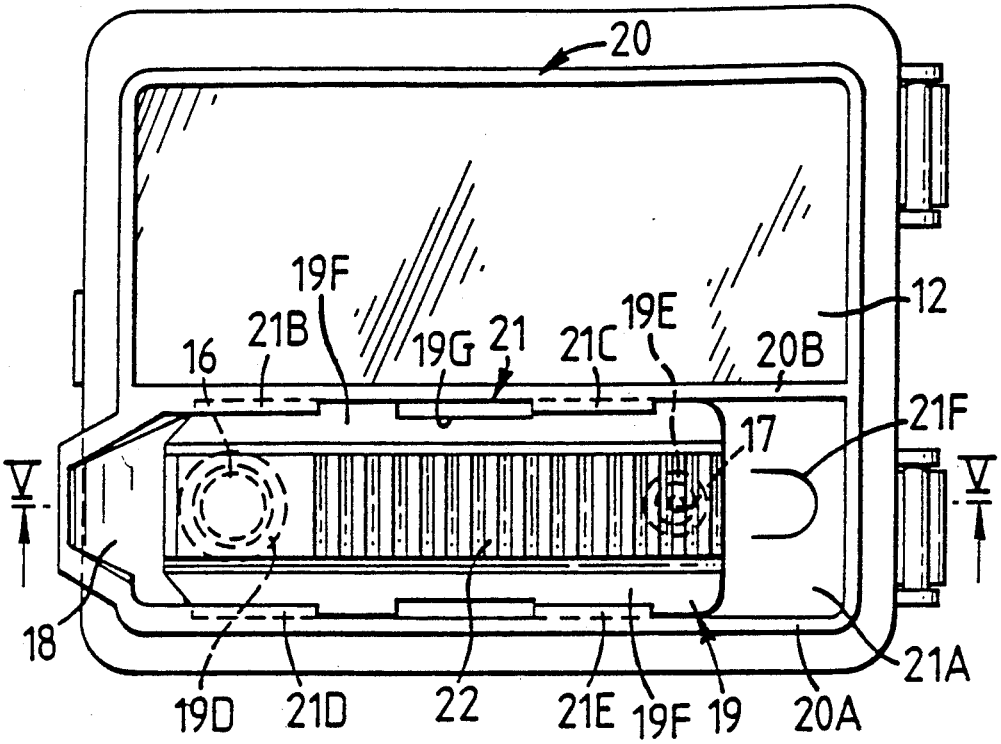
FIG. 3 is a plan of FIG. 1 with the outlet and the vent hole closed by the slider.

Two apertures 16 and 17 (see FIGS. 4 and 5) are formed in the lid 12. The apertures 16 and 17 are both offset to the left, as seen in FIG. 3, of the vertical axis of the side wall 11. The aperture 16 is adjacent the edge of the lid 12 remote from the side wall 11. It serves as an outlet through which liquid is poured from within the vessel 10 when the lid 12 is closed and the lid 12 is profiled at the upper end of the aperture 16 to form a spout 18. The other aperture 17, which has a smaller diameter than the aperture 16 and which is nearer to the hinge, serves as a vent hole.

Each aperture 16, 17 is associated with a respective depending puncture projection 16A, 17A, which is formed integrally with the lid 12 from which it depends. Each puncture projection 16A, 17A tapers to a point at its lower end and has a respective passage formed through it by which the respective aperture 16, 17 communicates with the interior of the vessel 10 when the lid 12 is closed. Each puncture projection 16A, 17A carries a generally frusto-conical seal ring 16B, 17B of the kind which comprises an array of axially-spaced radially-outwardly projecting ribs. When the vessel 10 has been loaded with a sealed semi-rigid rectangular container 15 of a beverage such as a fruit juice, the action of closing the lid 12 causes the puncture projections 16A and 17A to pierce the top of the semi-rigid container 15 so that the lower end of the passage through each projection 16A, 17A communicates with the interior of the semi-rigid container 15. The seal rings 16B and 17B are so located that they seat upon the top of the semi-rigid container 15, around the respective puncture, when the lid 12 is closed and thereby serve to seal against seepage of beverage from within the semi-rigid container 15 passed the respective puncture projection 16A, 17A.

The spout 18 is at one corner of a rectangle formed on the top of the lid 12 by an upstanding wall 20, and is located symmetrically between the longer sidewall 20A of that rectangle, which sidewall 20A is nearer to the apertures 16 and 17 than is the other longer sidewall of that rectangle, and an intermediate upstanding wall 20B which is parallel to that longer sidewall 20A. The upstanding wall 20 and the intermediate upstanding wall 20B are integral with the lid 12.

An elongate flat slider 19 is constrained in constraining means comprising slideway structure 21 formed on the top of the lid 12 for rectilinear sliding movement on the surface of the lid 12 over the two apertures 16 and 17. Serrations 22 are formed in about three quarters of the upper surface 19A of the slider 19 extending from the end thereof nearer to the side wall 11. FIG. 5 shows the serrated portion of the upper surface 19A is undulated to provide a hollow in which a thumb can be engaged. The underside of the slider 19 comprises two spaced bosses 19B and 19C which each have an annular groove formed therein, there being an 'O'-ring seal 19D, 19E seated in each annular groove. The 'O'-ring seals 19D and 19E are the portions of the slider 19 which slide on the base 21A of the slideway structure 21, the remainder of the slider 19 being spaced from the base 21A. The spacing of the centres of the 'O'-ring seals 19D and 19E is substantially the same as the spacing of the centres of the apertures 16 and 17 so that the bosses 19B and 19C and their seals 19D and 19E close the outlet aperture 16 and the vent hole 17 when the slider 19 is at the end of its travel furthest from the side wall 11, as shown in FIGS. 3 and 5.

The slider 19 has a laterally projecting flange portion 19F extending along it at either side. Each flange portion 19F has a rectangular recess 19G formed substantially at the centre of its outer edge. The slideway structure 21 includes the parallel side wall 20A and intermediate wall 20B, and spaced tabbed portions 21B, 21C, 21D and 21E which project from the top of each of the walls 20A and 20B towards the other. The flange portions 19F, the rectangular recesses 19G and the tab portions 21B to 21E are arranged symmetrically about the longitudinal centre line of the slideway 21, which passes through the centres of apertures 16 and 17, such that the slider 19 is retained in the slideway 21 by engagement of the flange portions 19F under the tab portion 21B to 21E except when the slider 19 abuts the wall 20 remote from the spout 18. The slider 19 can be extracted from the slideway 21 for cleaning or to replace worn 'O'-rings 19D, 19E, when it is in the latter position because the rectangular recesses 19G are aligned with the tab portions 21C and 21E further from the spout 18 and the flange portions on either side of the recesses 19G are aligned with similarly sized gaps on either side of the tab portions 21C and 21E.

Figure 4:
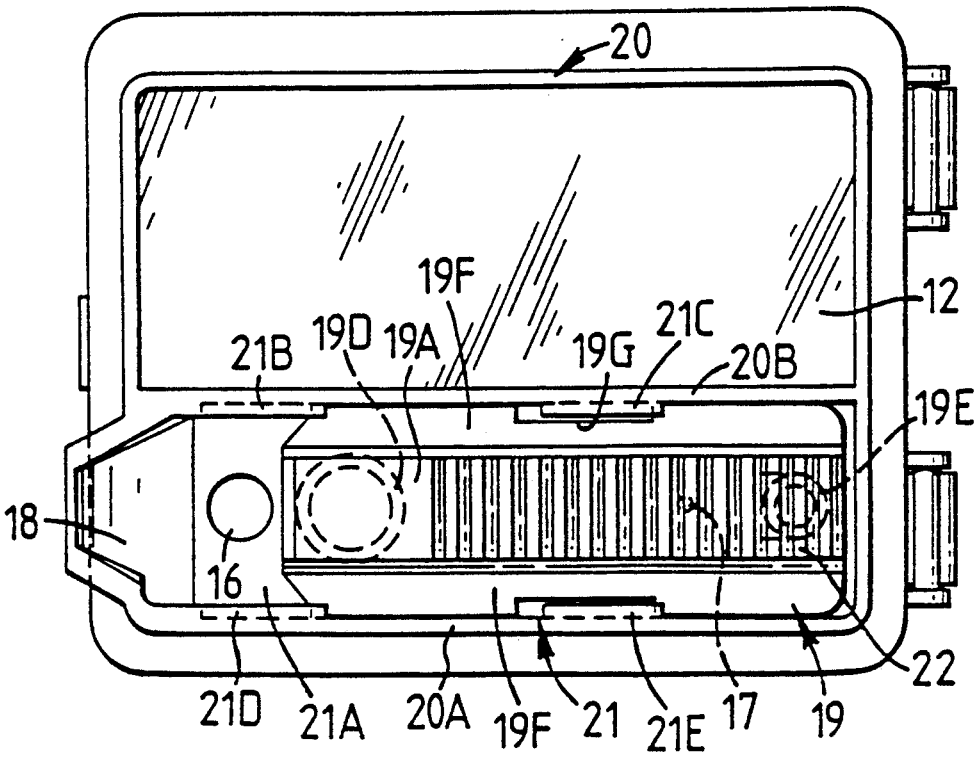
FIG. 4 is a view similar to FIG. 3 but with the container in its pouring mode.

A recess 21F (see FIG. 5) is formed to receive the smaller 'O' ring seal 19E when the slider 19 is in its normal retracted position remote from the spout 18, as shown in FIG. 4, in which the outlet opening 16 is exposed whilst the slider 19 is retained in the slideway 21 by engagement of its flange portions 19F below the tabs 21B to 21E. The vent hole 17 is open in this condition because the whole of the slider 19, apart from the 'O'-rings 19D and 19E, is spaced from the base 21A.

The two longer side walls 23 and 24 of the container 10 have opposed vertical recesses 25 formed in them adjacent to the side wall 11. These recesses 25 extend from near the top of the vessel 10 partway down and form a shallow inward projection to receive the fingers or thumb of a hand so that the vessel 10 can be gripped. The outer surface of each recess 25 is serrated as shown in FIGS. 1 and 2, but it could be profiled to receive individual fingers or a thumb.

Locating ribs 26 project inwardly from the inner surface of each of the sidewalls 23 and 24. Each rib 26 extends from the top part way down the respective sidewall 23, 24 of the container 10. The ribs 26 are located adjacent to the corner formed at either end of the respective sidewall 23, 24 with the adjacent end wall of the container 10. The ribs 26 locate a semi-rigid container 15 relative to the puncture projections 16A and 17A so that the latter do not pierce the usual seam that is formed slightly off centre in the top of the conventional aseptic package regardless of which way round the container 15 is inserted into the container 10.

The container 10 has short feet 27 formed at each corner and a skirt portion 28 extends along the bottom of each of the longer sidewalls 23, 24 between the feet 27 at the ends thereof. The feet are designed to fit snugly into a respective one of the four corners of the rectangle bounded by the upstanding wall 20 of a lid 12 of another similar container to facilitate stacking of the containers one upon another, each container being located by the wall 20 of the one below it. The skirt portion 28 of such a container that is stacked upon another passes over the outer flange portion 19F of the slider 19 of the lower of the two containers.

Figure 1:
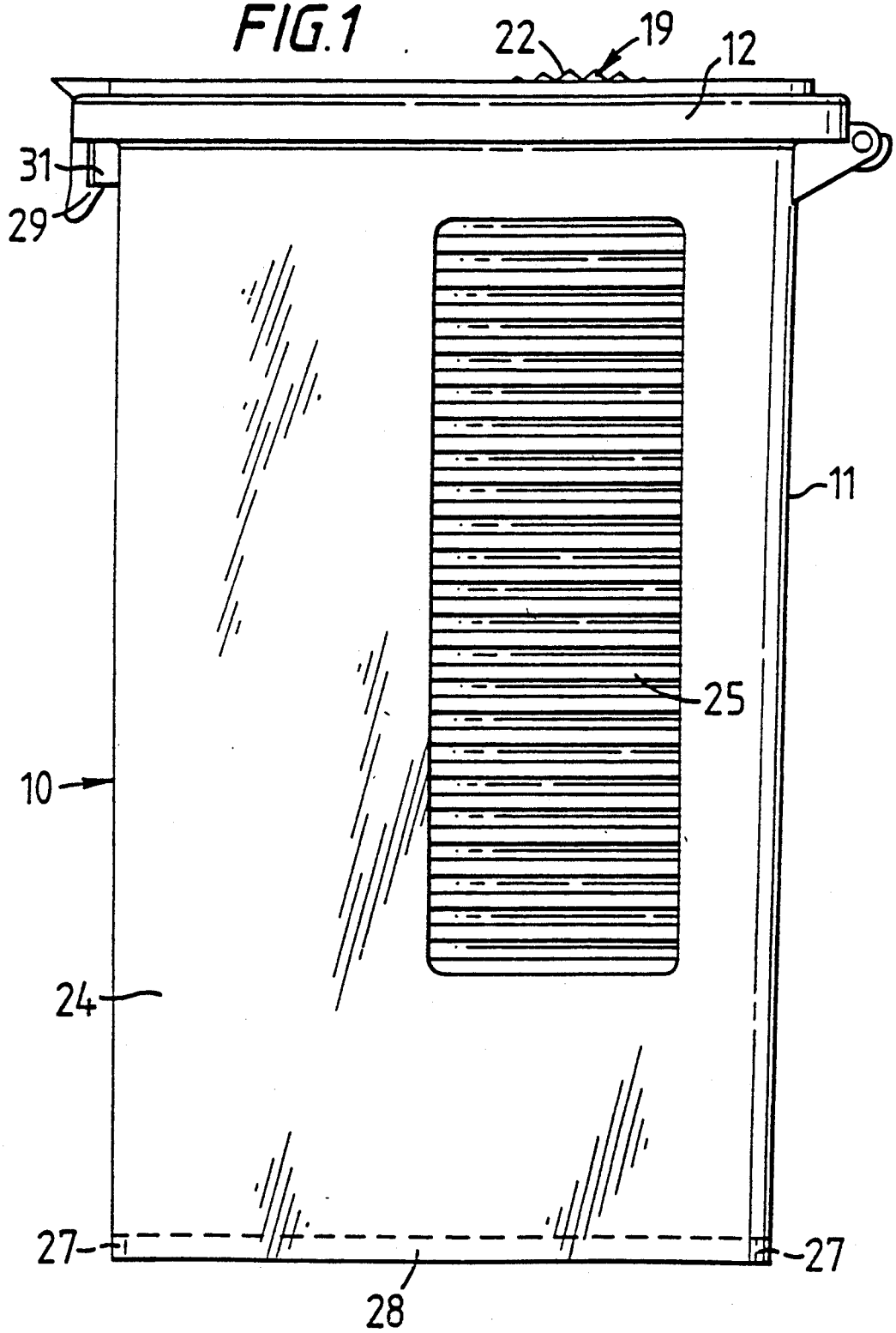
FIG. 1 is a side elevation of the container in its storage mode.
Figure 2:
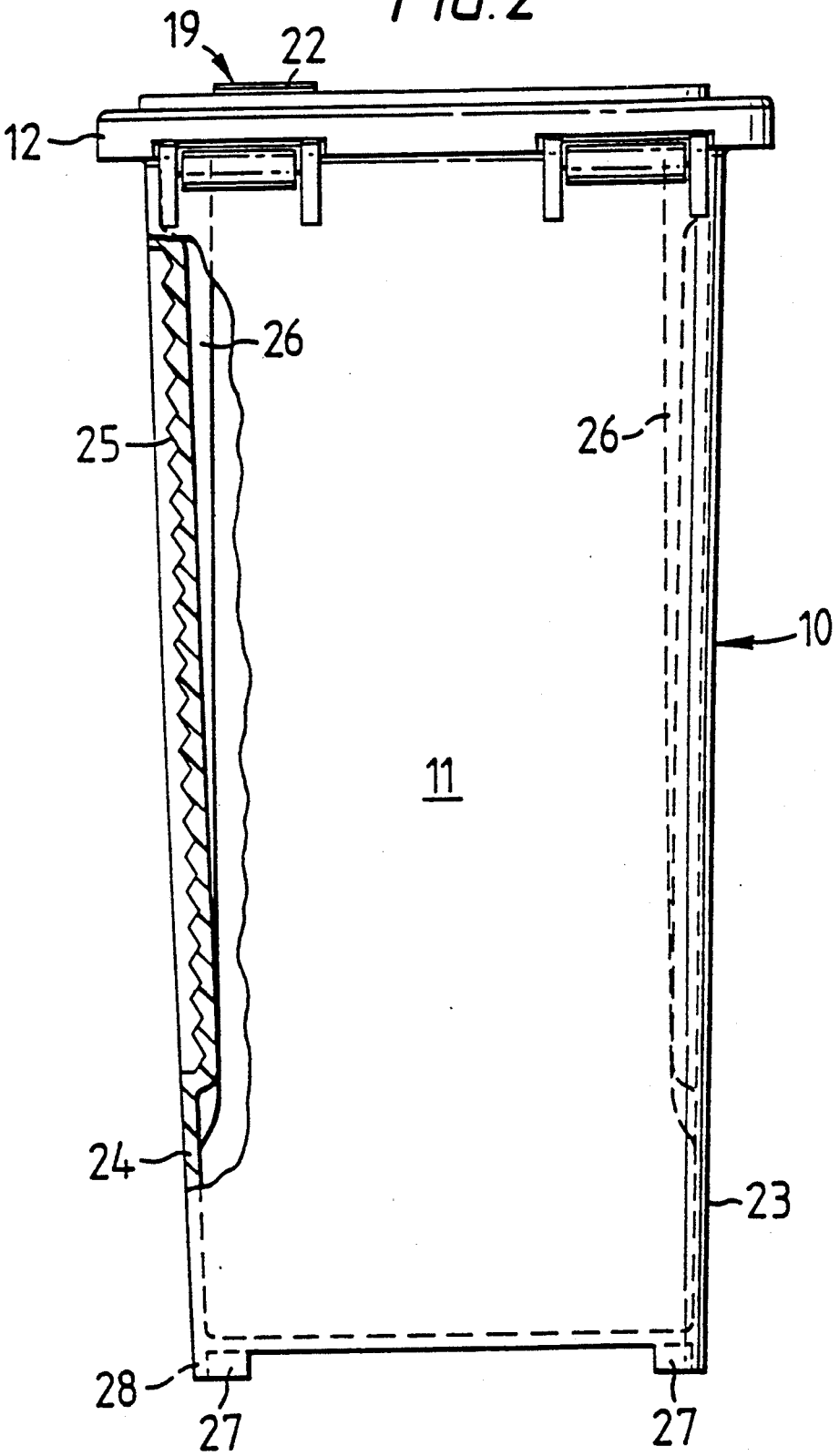
FIG. 2 is an end elevation of FIG. 1 partly cut-away to show hidden detail and as seen from the right in FIG. 1.

FIGS. 1 and 5 show that the lid 12 is provided with a snap fit catch comprising a resilient latch 29 depending from the centre of the lid 12 at its edge remote from its hinges, the latch 29 being adapted to cooperate with a corresponding keeper 31 formed on the container 10.

To pour liquid from a semi-rigid container 15 loaded into the vessel 10, after closing the lid 12, one grasps the vessel 10 by the fingers of one hand in one of the recesses 25 and the thumb of that hand in the opposite recess 25. With the slider 19 in position to close the outlet 16 and the vent hole 17 (as shown in FIG. 3), one can shake the whole container so as to shake the contents of the semi-rigid beverage container 15. The outlet opening 16 and the vent hole 17 are then uncovered by withdrawing the slider 19 with the other hand. Liquid can now be poured from the semi-rigid container 15 through the opening 16. After pouring liquid from the semi-rigid container 15, assuming that it is not empty, one would reclose the outer container by pushing the slider 19 back. The outer container, and hence the semi-rigid container 15 within it, are now fully closed and sealed for storage.

The internal volume of the vessel 10 may be varied by the use of inserts which are placed in the bottom of the vessel 10 to form a false bottom for a respectively sized semi-rigid container.

In a modification, instead of providing the 'O'-ring seals 19D and 19E, the underside of the slider may be flat and may be lined with a layer of elastomeric material which is slightly compressed from its natural relaxed condition by being squeezed between the rigid portion of the slider and the lid. The elastomeric material serves to seal the apertures 16 and 17. Such a flat slider would be formed with a vent hole positioned such that it can be aligned with the vent aperture 17 when the outlet aperture 16 is uncovered by the slider.

A non-return valve may be provided in the passage leading through the puncture projection 16A to the outlet opening 16 if required.

The sealed beverage container 15 may comprise a rectangular carton lined with a metal foil. Two apertures may be provided in the top of the carton and so positioned as to be pierced by a respective one of the puncture projections 16A and 17A as the lid 12 is closed when the container is inserted into the vessel 10. Before insertion the apertures are closed by the metal foil lining which extends across them and serves as a puncturable membrane.

I claim:

1. A beverage container comprising an open topped vessel having a rectangular cross-section and being formed of a rigid material in which a sealed semi-rigid rectangular beverage package is to be placed, the cross-section of the bottom of the open topped vessel being substantially the same as that of the package that is to be placed thereon, and a hinged lid which has depending puncture means associated respectively with a vent hole and an outlet through which liquid contained in the semi-rigid package can be poured from the container, the outlet and the vent hole being formed in the lid which is arranged so that the puncture means pierce the top of the sealed package when that sealed package is placed upon the bottom of the open topped vessel as the lid is closed, there being passages in each puncture means leading to the respective one of the outlet and the vent hole whereby the liquid contained in the semi-rigid package can be poured through the outlet via the respective passage in the puncture means wherein the open topped vessel tapers from its top to its bottom and has a recess formed in a side wall to receive fingers of a hand by which the container is gripped, the taper being formed so as to permit insertion of the sealed beverage package into the open topped vessel without obstruction by the inner wall of the recess, and to permit stacking of such beverage containers one upon another, as well as side by side, with minimal waste space between them, there being inwardly projecting means which locate the sealed package relative to the puncture means when the sealed package is placed upon the bottom of the open topped vessel, the inwardly projecting means comprising the inner wall of the recess.

2. A beverage container according to claim 1 wherein said recess is formed in each of an opposed pair of side walls.

3. A beverage container according to claim 1 or claim 2, including a closure member and constraining means on the lid whereby the closure member is constrained for sliding movement relative to and in contact with the lid between one position in which it closes the outlet and the vent hole and another position in which they are both open to allow a discharge of the liquid from the package through the outlet.

4. A beverage container according to claim 3, wherein the closure member is offset relative to the longitudinal axis of the lid so that it can be moved between said two positions.

5. A beverage container according to claim 3, wherein the closure member is a flat elongate slider which is constrained by said constraining means for lengthwise rectilinear movement relative to the lid.

6. A beverage container according to claim 4, including locating ribs, wherein the rectangular open topped vessel includes a pair of longer side walls, said locating ribs being formed at spaced locations on the upper portions of the inner surface of the longer side walls for locating, along with the inner wall of the recess, the beverage package therein relative to the puncture means.

7. A beverage container according to claim 1 or claim 2, wherein each depending puncture means is provided with sealing means adapted to seat upon the top of the sealed liquid package within the open topped vessel, around an aperture formed in that sealed package by piercing with the puncture means as the lid is closed, to seal against seepage of beverage liquid from within the package around the puncture means.

8. A beverage container according to claim 1 or claim 2, wherein the open-topped vessel is recessed at its bottom for stacking.

9. A beverage container according to claim 1 or claim 2, wherein the top of the lid is provided with an upstanding wall surrounding a rectangular space within which the bottom of the open-topped vessel of another, similar container can be received for location when stacked thereon.

10. A beverage container comprising an open topped vessel having a rectangular cross-section and being formed of a rigid material in which a sealed semi-rigid rectangular beverage package is to be placed, the cross-section of the bottom of the open topped vessel being substantially the same as that of the package that is to be placed thereon, and a hinged lid which has depending puncture means associated respectively with a vent hole and an outlet through which liquid contained in the semi-rigid package can be poured from the package, the outlet and the vent hole being formed in the lid which is arranged so that the puncture means pierce the top of the sealed package when that sealed package is placed upon the bottom of the open topped vessel as the lid is closed, there being passages in each puncture means leading to the respective one of the outlet and the vent hole whereby the liquid contained in the semi-rigid package can be poured through the outlet via the respective passage in the puncture means, wherein the top of said lid is provided with an upstanding wall surrounding a rectangular space within which the bottom of the open topped vessel tapers from its top to its bottom and has a recess formed in a side wall to receive fingers of a hand by which the container is gripped, the taper being formed so as to permit insertion of the sealed beverage package into the open top vessel without obstruction by the inner wall of the recess, and to permit stacking of such beverage container one upon another, as well as side by side, with minimal waste space between them, there being inwardly projecting means which locate the sealed package relative to the puncture means when the sealed package is placed upon the bottom of the open top vessel, the inwardly projecting means comprising the inner wall of the recess.

* * * * *